United States Patent [19]

Petro et al.

[11] 3,939,898

[45] Feb. 24, 1976

[54] MOULD MANUFACTURING DEVICE

[76] Inventors: Claude Petro, 3 rue des Alpes, Geneva, Switzerland; Andre Glise, Le Coin, Collonges-Sous-Saleve, France

[22] Filed: Nov. 26, 1973

[21] Appl. No.: 419,055

[52] U.S. Cl. ..... 164/150; 164/244; 164/237; 164/DIG. 4; 33/180 R; 264/221; 264/317

[51] Int. Cl.[2] ..... B22C 7/02; B22C 13/00

[58] Field of Search ..... 425/175, 180, 179; 249/142, 160; 29/200 P, 271; 164/159, DIG. 4, 150, 244, 237; 264/275, 277, 221, 317; 33/180 R

[56] References Cited

UNITED STATES PATENTS

| | | | |
|---|---|---|---|
| 269,499 | 12/1882 | Hamilton | 33/180 R |
| 1,878,296 | 9/1932 | Schmidt et al. | 29/271 |
| 2,314,377 | 3/1943 | Van Rossem | 425/180 |
| 2,591,314 | 4/1952 | Stelmoch | 33/180 R |
| 3,182,358 | 5/1965 | Van Rossem | 425/175 X |
| 3,648,760 | 3/1972 | Cooper | 164/DIG. 4 |
| 3,741,701 | 6/1973 | Nelson | 425/175 |

FOREIGN PATENTS OR APPLICATIONS

| | | | |
|---|---|---|---|
| 543,102 | 12/1955 | Belgium | 29/271 |

*Primary Examiner*—Ronald J. Shore
*Attorney, Agent, or Firm*—Young & Thompson

[57] ABSTRACT

In the manufacture of a mould by the so-called lost wax method, the position and space occupied by a set of blank-carrying elongate members of fusible or calcinable material supported on an ogival head or cone are controlled by a gauge including a ring slidably mounted along a vertical rod. The gauge is then replaced by a cylinder forming a receptacle which receives a hardenable refractory material embedding said set. After hardening, the cone is removed and the fusible or calcinable material removed by heating to provide mould cavities.

3 Claims, 2 Drawing Figures

MOULD MANUFACTURING DEVICE

Figure 1:
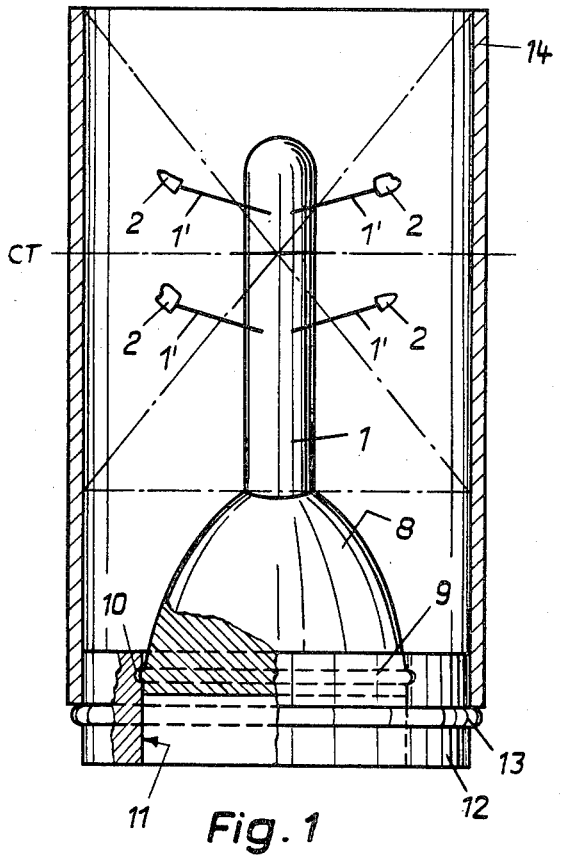

The invention relates to moulding by the so-called "lost wax" method.

In known lost wax moulding, the mould is produced by placing on a crucible-forming supporting cone flow rods connected to blanks of wax or other fusible material, the assembly being embedded in a hardenable heat-resistant material which is then baked in an oven. There is thus obtained a mould for casting objects whose shape is given by cavities formed by spaces in the hardened material formerly occupied by the blanks. This known process only enables a limited number of pieces to be cast since, in view of the arrangement of the flow rods on the supporting cone, the blanks may be too close to one another and come to touch one another or come into contact with the envelope surrounding them, into which the hardenable material is poured. Moreover, the mould is formed without taking into account the optimal thermal conditions.

Placing the envelope around the set of blanks carried by the supporting cone, prior to filling the envelope with the hardenable heat-resistant material, is very delicate and involves difficulties since the joining members fixed on the cone and the blanks carried thereby must be confined in a space such that they cannot touch the inner wall of the cylinder or envelope when it is placed.

Also the set of blanks should have a given height in relation to the cylinder or envelope, this height always being the same for a certain type of manufacture. This is important since to obtain a flawless and homogeneous moulding, the cavities for moulding the pieces must be in a particular position in relation to the thermal centre of the mould.

The invention aims to provide a solution enabling these requirements to be taken into account.

The invention provides a mould manufacturing device comprising a support including an ogival head having a vertical axis and being adapted to support a set of elongate joining members carrying blanks of pieces to be moulded in calcinable or fusible material generally above the ogival head about said vertical axis; a tubular member adapted to be removably fitted on the support generally coaxial with said vertical axis to form, with the support, a receptacle for receiving a hardenable refractory material to cover the ogival head and a supported set of joining members and blanks, said tubular member being removable from the support after hardening of the refractory material together with the hardened refractory material and embedded set which form, after removal of the calcinable or fusible material by heating, a mould including a funnel-like opening communicating with cavities formed by spaces formerly occupied by said blanks; and gauge means for controlling the position of the blanks of a supported set prior to fitting of the cylindrical member on the support, said gauge means including a ring and means for mounting the ring on the support generally coaxial with said vertical axis and in a horizontal plane for a vertical sliding movement above and generally about the ogival head.

Figure 2:
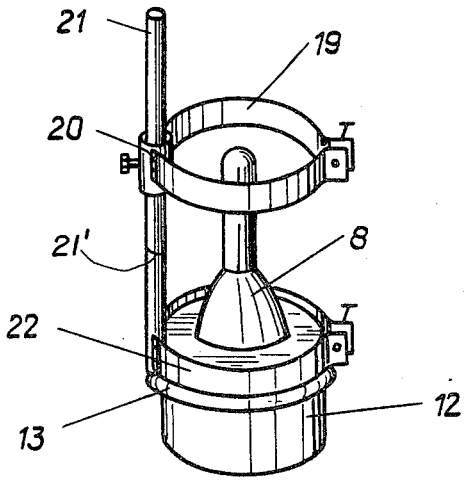

The invention will now be particularly described, by way of example, with reference to the accompanying schematic drawings, in which:

FIG. 1 is a side elevational view, partly in cross-section, of a tubular cylindrical member and a plurality of blanks mounted on a support during one phase of the use of the device of the invention; and FIG. 2 is a perspective view of a gauge device mounted on the support.

With reference to FIG. 1, an ogival head or cone 8 carries a set of blanks 2 of pieces, for example teeth, to be moulded on rods 1' protruding from an axial cylindrical protuberance 1 of cone 8. Blanks 2 and rods 1' are provided in a suitable calcinable or fusible material. Near its base, cone 8 is provided with a peripheral bulge 9 which fits in a corresponding groove 10 in a housing provided inside a ring 12 of greater diameter, forming a base part of a support. The ring 12 also has an external peripheral bulge 13 on which rests a tubular cylinder 14 fitting about the outer cylindrical surface of ring 12, and surrounding the set of blanks 2 carried by cone 8.

The support may comprise several rings like ring 12, telescopically mounted, the last ring of greatest diameter serving to support a tubular cylinder of corresponding diameter adapted to surround a more bulky set of blanks carried by the cone.

FIG. 2 shows a gauge for measuring and controlling the space occupied by the set of blanks 2 on cone 8, with a view to ensuring an exact positioning thereof inside cylinder 14. This gauge comprises a ring 19 made in two parts hingedly mounted (about a vertical axis) on a tube 20 slidably mounted along a vertical rod 21, a screw being provided for setting tube 20 and ring 19 at any selected height along rod 21. Rod 21 is fixed at its lower end onto a ring 22 which is also made in two hingedly mounted parts. Ring 22, when closed by appropriate means, fits closely about the cylindrical outer surface of ring 12, resting on bulge 13. Rod 21 can, as shown, be of circular cross-section, or can be polygonal, for example square.

The described gauge enables control of the space occupied by the set of rods 1' and blanks 2 carried thereby. For this purpose, the ring 19, closed by appropriate means, is slid along rod 21 and the positions of rods 1', which can be set by hand, are modified as necessary until the ring 19 can pass about the entire set without its inner surface contacting the set. Moreover, the height of the blanks 2 can be adjusted by gauging with the upper or lower edge of ring 19 set in any particular position, as a function of the height of the cylinder 14, which is always of a given value for each application. The rod 21 can, for example, carry a graduation 21' or graduations indicating that the upper or lower edge of ring 19 is at a height corresponding to the thermal or thermic centre of a finished mould (indicated by CT in FIG. 1), i.e. the zone of the mould that retains heat longest.

As a variation, the ring 19 could be narrower (heightwise) and its height adjusted in relation to a graduation 21' on rod 21 so that it can be set at the position corresponding to the thermal centre of the mould.

Once the ring 19 is secured in this position, the height of the set of blanks 2 carried by cone 8 is adjusted, for example by shortening or lengthening the rods 1'. It would also be possible to slidably mount protuberance 1 in cone 8 for this purpose.

The described gauge enables avoidance of the drawbacks involved in known methods of directly passing the cylinder 14 over the set of blanks 2 without a prior control, notably an avoidance of damage to the set of blanks 2 and their support rods 1' carried by cone 8.

The gauge is removed by opening out rings 19 and 22 to provide an opening at least as great as the diameter of the closed rings, and withdrawing the rod 21 and rings 19 and 22 laterally, which avoids any catching with the supported set.

Once the gauge is removed, cylinder 14 is placed on ring 12 resting on bulge 13, as shown in FIG. 1.

A hardenable heat resistant material, for example a refractory plaster, is then poured into cylinder 14 which forms, with ring 12, a receptacle, to fill or almost fill this receptacle and thus entirely cover the supported set of blanks 2, rods 1' and the protuberance 1. This material is then allowed or caused to harden, and the supporting cone 8 is removed from the set material or, rather, the hardened material, together with cylinder 14, blanks 2 and rods 1' is removed from the support. The hardened material is then baked at a temperature sufficient to calcinate or melt the material forming rods 1' and blanks 2, the residual matter being removed by the central hole corresponding to the space previously occupied by protuberance 1.

There is thus provided a mould having a funnel-like opening, corresponding to the space previously occupied by cone 8, communicating via channels with casting cavities formed by the spaces previously occupied by blanks 2. The funnel-like opening enables the supply, for example under pressure, of fused material for casting objects in the cavities formed by blanks 2.

Of course, accessories could be provided to enable the described gauge to be adapted to supports or tubular envelopes of other than cylindrical shape, and the annular gauge instead of being a circular ring could have an orifice of corresponding non-circular shape.

What we claim is:

1. A mold manufacturing device comprising a support, an ogival head extending vertically above said support to support in turn a set of rods carrying blanks of pieces to be molded in calcinable or fusible material, a lower ring detachably secured to said support in surrounding relationship, a vertical rod carried by and upstanding from said lower ring, an upper ring mounted for vertical sliding movement on said rod coaxially with said lower ring, said upper ring being horizontally disposed, there being at least one graduation on said rod indicating the position of the upper ring along said rod relative to the location of the thermal center of a mold to be cast on said support about said head after said rod and rings are removed from said support, and means for releasably securing said upper ring in predetermined positions along said rod.

2. A device as claimed in claim 1, said support having a cylindrical upper side wall that terminates downwardly in an upwardly facing annular shoulder that contacts the lower edge of said lower ring.

3. A device as claimed in claim 1, each of said upper and lower rings being formed in two parts pivotally connected about an axis parallel to said rod thereby to permit the two parts of each ring to pivot between a closed position and an open position providing an opening at least as great as the diameter of the rings when closed.

* * * * *